US006517282B2

(12) United States Patent
Marsteller et al.

(10) Patent No.: US 6,517,282 B2
(45) Date of Patent: Feb. 11, 2003

(54) EROSION CONTROL MATS

(75) Inventors: Richard A. Marsteller, Flower Mound, TX (US); Terence J. Whalen, West Palm Beach, FL (US); Hans E. Heyn, Eureka Springs, AR (US)

(73) Assignee: HEI LLC, Flower Mound, TX (US)

( * ) Notice: Subject to any disclaimer, the term of this patent is extended or adjusted under 35 U.S.C. 154(b) by 0 days.

(21) Appl. No.: 09/855,119

(22) Filed: May 14, 2001

(65) Prior Publication Data

US 2002/0192036 A1 Dec. 19, 2002

(51) Int. Cl.[7] ..... E02B 3/04
(52) U.S. Cl. ..... 405/24; 405/21; 405/25
(58) Field of Search ..... 405/24, 25, 21

(56) References Cited

U.S. PATENT DOCUMENTS

| | | | | |
|---|---|---|---|---|
| 4,437,786 A | | 3/1984 | Morrisroe | 405/24 |
| 4,441,453 A | * | 4/1984 | McMickle et al. | 405/24 X |
| 4,478,533 A | * | 10/1984 | Garrett | 405/24 |
| 4,490,071 A | | 12/1984 | Morrisroe | 405/24 |
| 4,534,675 A | | 8/1985 | Morrisroe | 405/24 |
| 4,641,997 A | | 2/1987 | Lauer et al. | 405/24 |
| 4,710,057 A | | 12/1987 | Laier | 405/30 |
| 4,722,639 A | | 2/1988 | Alsop | 405/25 |
| 5,007,766 A | | 4/1991 | Freed et al. | 405/24 |
| 5,056,956 A | | 10/1991 | Nicholson | 405/17 |
| 5,102,257 A | | 4/1992 | Creter | 405/25 |
| 5,113,792 A | | 5/1992 | Jones et al. | |
| 5,141,359 A | | 8/1992 | Klockner | 405/26 |
| 5,158,395 A | | 10/1992 | Holmberg | 405/21 |
| 5,176,468 A | | 1/1993 | Poole | 405/23 |
| 5,176,469 A | | 1/1993 | Alsop | 405/24 |
| 5,257,878 A | | 11/1993 | Peterson | 405/15 |
| 5,468,560 A | * | 11/1995 | McPherson et al. | 428/413 |
| 5,575,584 A | | 11/1996 | Alsop | 405/24 |
| 6,218,024 B1 | * | 4/2001 | Tamber et al. | 428/520 |

OTHER PUBLICATIONS

Brochure of Hydro Engineering International Inc., disclosing Erosion Control Products (undated).

* cited by examiner

*Primary Examiner*—David Bagnell
*Assistant Examiner*—Sunil Singh
(74) *Attorney, Agent, or Firm*—R. L. Graham

(57) ABSTRACT

An erosion control mat having buoyant fronds is deployed in a body of water to enhance the accumulation of sediments. The mat includes a plurality of frond lines arranged in a fanfold pattern. Each frond line include a continuous elongate strip and a plurality of side-by-side buoyant fronds (strands). The frond lines are made of linear low density polyethylene (LLDPE), preferably metallocene catalyzed LLDPE.

4 Claims, 2 Drawing Sheets

EROSION CONTROL MATS

FIELD OF THE INVENTION

This invention relates to underwater structures or devices for preventing erosion of river or sea beds. In one aspect, the invention relates to mats having a large number of buoyant strands (fronds) deployed to prevent erosion around underwater structures such as pilings, offshore structures, cables, and the like. In another aspect, the invention relates to structures for enhancing the accumulation of sediment on the sea floor.

BACKGROUND OF THE INVENTION

Worldwide, the forces of nature are ceaselessly at work reshaping beaches, riverbeds, and the sea floor. Currents, tides, and wave action work in concert and individually to continually shift sediment. When structures such as pipelines and cables are placed in these environments, water is forced around these objects, causing local current velocities to increase. Higher current velocities, in turn, scour away the supporting sediment, resulting in erosion, destabilization, and eventual structure failure.

Historically, solutions for scour have included dumping rocks, placing concrete mattresses, or employing other remedial measures. In addition to causing damage and further scour on their own, these "solutions" are extremely expensive and often short-lived.

More recent solutions to the erosion problem have been frond lines or mats. These devices employ a large number of buoyant synthetic strands (fronds) which, when deployed on the sea bed, resemble natural sea grass or seaweed. These artificial reed-like strands create sufficient viscous drag on currents flowing therethrough to cause sediments to deposit and accumulate in the region of deployment. The accumulation forms a permanent consolidated sandbank.

Representative examples of prior frond lines and mats are disclosed in U.S. Pat. Nos. 3,299,640; 4,337,007; 4,722,639; and 5,176,469. Many of these patents, particularly the more recent ones, disclose the preferred frond material to be polypropylene. While underwater erosion control mats made of polypropylene have performed well, and in fact are still performing well in their applications, they also have a number of shortcomings. These shortcomings have become evident in recent years, when the field of use of these mats was broadened beyond their initial applications. The first shortcoming is die-cuttability of the polypropylene film from which the strands, or fronds, are made, which is essential to achieve acceptable manufacturing costs. The second shortcoming is strand density, which needs to be as low as possible in order for these mats to perform well in fresh water and in shallow estuaries subject to tides. A third shortcoming is also associated with applications in shallow tidal areas, where part or all of the strands may be above water from time to time, and under these conditions are subject to ultraviolet radiation from the sun. A fourth shortcoming is that under certain circumstances, the strands, or fronds, of these mats can become covered with algae and the like, which increase their weight and cause the strands, or fronds, to lose their buoyancy. The invention, described in detail below, overcomes these four principal shortcomings, and gives underwater erosion control mats long-lasting utility in every imaginable salt and fresh water environment.

SUMMARY OF THE INVENTION

The erosion control mat of the present invention comprises a series of frond lines wherein each frond line includes an elongate base strip and a plurality of buoyant strands extending upwardly from the base strip. The strands are made of linear low density polyethylene (LLDPE), preferably a LLDPE produced by a metallocene or other single site catalysed process.

The base strip and strands are preferably integral, being formed from a single film sheet die in the form of a continuous base strip and a plurality of strands extending upwardly therefrom. The base strip may be folded longitudinally to provide a double layer for reinforcement.

The series of frond lines are preferably made from a continuous slitted film folded back and forth to form a fanfold array. This structure is deployed and anchored to the sea floor and provides a series of frond curtains through which water current flows. The viscous drag of water current flowing through these curtains of fronds causes the sediments to deposit and accumulate within this structure.

DESCRIPTION OF THE PREFERRED EMBODIMENTS

Figure 1:
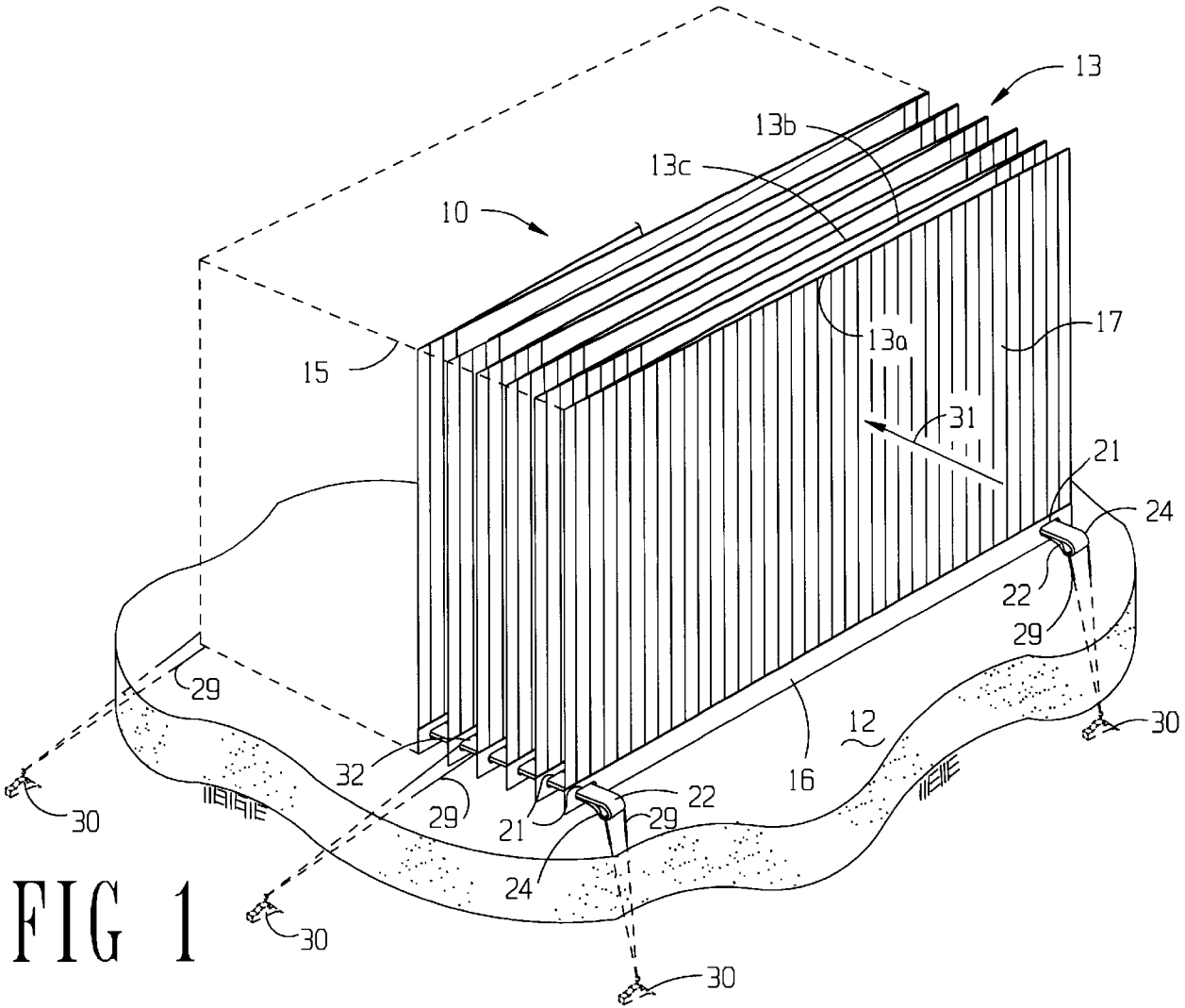
FIG. 1 is a perspective view of the erosion control mat mounted on the bed of a body of water.

FIG. 1 shows an erosion control mat 10 constructed according to the present invention deployed on a sea floor 12. The mat 10 comprises a continuous sheet 13 of a buoyant synthetic material (LLDPE as described below). The sheet 13 is folded back and forth in a fanfold arrangement, defining several sections, referred to as frond lines 13*a*, 13*b*, 13*c*, etc. The frond lines 13*a*, 13*b*, and 13*c* extend the full width of the mat 10, as indicated by line 15, and the folded sections extend the full length of the mat 10.

Figure 2:
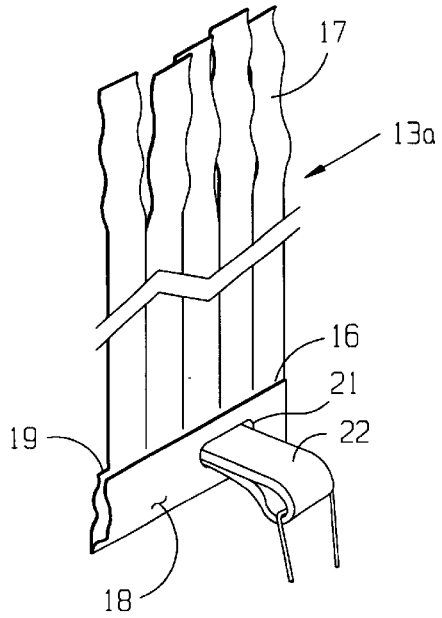
FIG. 2 is an enlarged view of a portion of the structure shown in FIG. 1 illustrating in more detail the fronds.
Figure 3:
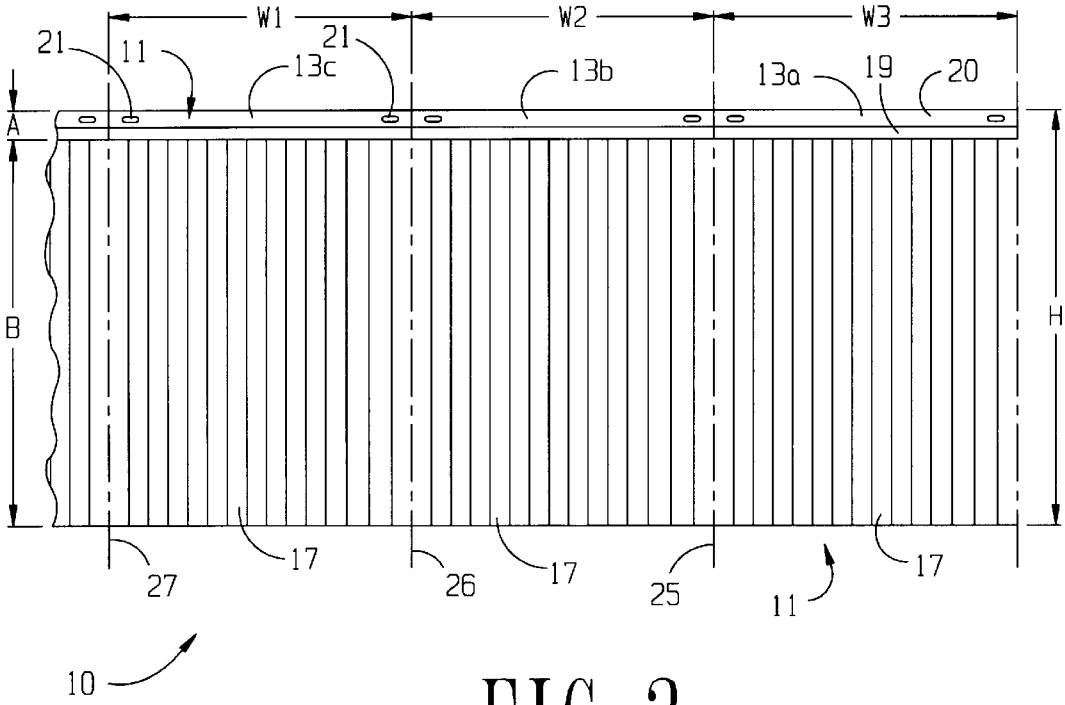
FIG. 3 is a top plan view of a film being processed into a frond line.

Each frond line (e.g. 13*a*) comprises a continuous base strip 16 and a plurality of buoyant strands 17 (i.e. fronds) extending upwardly from the base strip 16. The strands 17 of each frond line 13*a* are located side-by-side along the full length of the frond line 13*a* and are separated from each other. As best seen in FIG. 2, the strands 17 are buoyant in the water and resemble seaweed in that they sway to and fro in the water current. As shown in FIG. 3, the base strip 16 and strands 17 are preferably integral, being die cut from the same film.

Returning to FIG. 2, the base strip 16 is folded over to form a double layer 19 and 20 for reinforcement. Holes 21, in the form of slots, extend through the double layer base strip 16 of frond line 13*a* and are aligned with similar holes of other frond lines (e.g., 13*b* and 13*c*) of the complete mat 10. As shown in FIG. 1, similar aligned holes 21 are formed at the opposite edge of the frond lines 13*a*, 13*b*, 13*c*, etc. Each set of aligned holes 21 receives lines or straps 22 to hold the structure together. The straps may be made of woven synthetic such as polypropylene, or polyester or nylon. Each strap 22 may be secured to the frond lines by grommets to provide the desired spacing between the frond lines. Alternatively, spacing strands may be used to achieve the spacing as described in U.S. Pat. No. 5,176,469. The disclosure of U.S. Pat. No. 5,176,469 is incorporated herein as reference to provide details of features which are generally known in the art and form no part of the present invention. The ends of the strap may include loops 24 for attachment to anchor lines.

Although the dimensions of the mat 10 components may vary within a wide range, depending on the size and site of development, the following is representative:

| | Broad Range | Preferred Range |
|---|---|---|
| frond line (13a, 13b, or 13c) width, m | 1 to 5 | 2 to 4 |
| frond line length, m | 2 to 8 | 3 to 6 |
| frond line film thickness (mils) | 1 to 5 | 1½ to 2½ |
| strands (17) | | |
| width (cm) | 1.2 to 5 | 2 to 3.2 |
| length (m) | .3 to 2 | .5 to 1 |
| total number (sq. m) | 500 to 1500 | 1000 to 1200 |
| sets of aligned holes (21) w/straps (22) | 2 to 8 | 2 to 4 |

Variations in the design include separate frond lines arranged in paralleled relationship and separate base strips to which the strands 17 are attached. An example of separate frond lines is disclosed in U.S. Pat. No. 4,722,639.

Frond Material

The frond lines of the present invention are made of linear low density polyethylene (LLDPE), preferably LLDPE produced by metallocene or other single site catalysed process. Mixtures of LLDPE and metallocene or other single site catalyzed LLDPE may also be used.

LLDPE is a copolymer with alpha olefins with ethylene from about 3 to 10 carbon atoms and preferably 4 to 8 carbon atoms. Illustrative higher alpha-olefins include butene-1, hexene-1, and octene-1.

The manufacture of LLDPE is described at length in the patent literature. Films of LLDPE are commercially available in a variety of grades from a number of manufacturers including Tredegar, Clopay, and others.

The preferred LLDPE for use as strands 17 and frond lines 13 in the present invention are those manufactured by a process using a metallocene catalyst or other single site catalyst. One such process is described at length in U.S. Pat. No. 5,324,800, the disclosure of which is incorporated herein by reference. The catalyst disclosed therein comprises a metallocene component and an alumoxane. The metallocene component comprises derivatives of mono, bi, and tricyclopentadienyl. Films made by LLDPE using metallocene catalysts are commercially available from several companies including ExxonMobil under trade designation EXCEED, termoplastic resistors. Other metallocene cocatalysts include noncoordinating anions such as those disclosed in U.S. Pat. No. 5,153,157, the disclosure of which is incorporated herein by reference.

Other preferred LLDPE's include those made with other single site catalysts commercially available from chemical companies including Dow Chemical and its licensees.

Manufacture of the Erosion Control Mat

A roll of film (LLDPE OR LLDPE produced by a metallocene or single site catalysed process) is obtained and processed as a continuous sheet as follows:

1. The film between 1 to 5 mils thick is overlapped to form the double layers 19 and 20 of base strip 16.
2. The film is passed successively through a punch wherein holes 21 are punched at the desired location in the base strip.
3. The film is partially slit by a die-cutting machine to form the strands 17, but the strands 17 remain attached to one another.

FIG. 3 illustrates the film condition after step 3. Note that only three frond lines 13*a*, 13*b* and 13*c* are shown. In practice, the continuous film will extend for the full length of the mat. Each frond line 13*a*, 13*b*, and 13*c*, etc., will be folded back and forth along lines 25, 26, and 27 to form the fan-folded structure, with H representing the height of the mat, $W_1$, $W_2$, and $W_3$ representing the width, B representing the height of the strands 17 and A representing the height of the double layer reinforcing strip 16.

The final step in the process is to fanfold the frond lines and pass the retaining straps 22 (or lines as illustrated in U.S. Pat. No. 5,176,469) through the aligned holes 21. The structure is then suspended upside-down from the retaining straps and the partially cut strands are mechanically worked as by vigorous brushing. This separates the strands 17. The assembly is then placed in a dispensing box for shipment and deployment.

The LLDPE preferably should include effective amounts of one or all of the following additives:

UV stabilizers commercially available from several companies including Ciba-Geigy Corporation, Cytec Industrial Engineering, Hoechst-Celanese, and others at a concentration of 500 ppm to 1% by weight.

Biocides commercially available from Rohm & Haas, NGF Canada, and others at a concentration of 500 ppm to 1 wt. %.

Foaming agents commercially available from several companies including_Elf Atochem, and Uniroyal and at a concentration of 500 ppm to 10 wt. %.

Expandable microspheres such as manufactured by Exancel.

Deployment

Deployment of the mat on the sea bed may be achieved by a variety of methods and techniques. The selected technique of course will depend on the location and condition of the site.

For illustrative purposes, the mat 10 may be deployed as described in U.S. Pat. No. 5,176,469, referenced above. Briefly, a dispenser box containing the mat is placed on the seabed and the fan-folded leading frond lines 13*a*, 13*b*, 13*c*, etc. are removed and connected to anchor lines 29. The two leading anchors 30 are driven into the seabed. The dispensing box is then moved rearwardly dispensing additional frond lines. Side anchors are driven into the seabed and secured to the mat as at 32. When the final frond lines 13 are dispensed, the final anchors are anchored, securing the mat to the seabed. The anchors may be as described in the above referenced U.S. Pat. No. 5,176,469.

The mat generally is placed so that the frond lines are transverse or perpendicular to the current flow illustrated by arrow as 31.

The several frond lines thus define a series of frond curtains through which the water current flows. The drag forces caused by the strands reduces the velocity of the water current causing sediments such as sand, silt, and clay to deposit within the perimeter of the mat 10. The buildup of sediments with time may completely fill the mat to or near the upper ends of the strands 17, forming a permanent sand bank. The formation of the sand bank can be used to protect subsea pipes, cables, foundations, and the like. Moreover, the sand bank can enhance the growth of sand bars in coastal protection. It is thus seen that the erosion control mat can be used to remedy or prevent erosion as well as create the buildup of sand bars that would not normally occur.

Advantages of LLDPE Erosion Control Mats Over Polypropylene Erosion Control Mats As mentioned above, polypropylene has been the sythetic film of choice for use as buoyant fronds, but suffers from several shortcomings: die cuttability, density, ultraviolet stability, and fouling. LLDPE, particularly metallocene and single site catalyzed LLDPE, overcomes these shortcomings.

Experiments with die cuttability show that metallocene catalyzed LLDPE is far more suited for partial die cutting and strand separation than polypropylene. Owing to its molecular orientation during manufacture, polypropylene film is difficult to partially cut accurately.

In order to achieve best buoyancy in fresh water, lowest density is desired. By selecting linear low density polyethylene (with a S.G. of between 0.8 and 0.92) as principal polymer, already better buoyancy is realized than is offered by polypropylene. Densities less than 0.9 are preferred. Further reduction of density can be achieved by adding small amounts of foaming agents to the linear low density polyethylene. It is hereby important that the density remain above some minimum density (0.6) to retain the strength of the strands.

The original application of underwater erosion control mats were all in fairly deep water, where sunlight hardly penetrated, and where no ultraviolet radiation was present. In modern applications such as prevention of beach erosion, the mats are used in shallow water, where solar ultraviolet radiation is present. The tops of the strands used in these mats may actually float on the top of the water from time to time, in estuaries subject to tidal action. Polypropylene is extremely susceptible to ultraviolet radiation and falls apart after only a few months exposure.

Replacing polypropylene by metallocene catalyzed linear low density polyethylene improves the ability of the mats to withstand solar ultraviolet radiation. However, addition of special ultraviolet stabilizers to the linear low density polyethylene resin was found to be necessary in many shallow water applications, particularly in tropical and subtropical locations.

It was totally unexpected to find that underwater erosion control mats made from highly inert polypropylene resins could be fouled by algae and other microscopic marine life. It was expected that the inertness and smooth surface of the strands would prohibit this. But it was found that in several modern shallow fresh and salt water applications, fouling occurred at such rates that the strands lost their buoyancy before sufficient sand, silt, and clay was trapped between them.

It was found that adding certain additives to the metallocene or single site catalyzed linear low density polyethylene was able to stop this biological fouling action.

In summary, the erosion control mats of the present invention have a wide range of application, and, with proper selection of film and additives, can be deployed in almost any underwater environment where sediment deposition is desired.

What is claimed is:

1. A mat adapted to be employed in the bed of a body of water for sediment accumulation, which comprises:

(a) a plurality of frond lines arranged folded back and forth in a fanfold arrangement, each frond line comprising a continuous base strip and a plurality of side-by-side buoyant strands extending upwardly from the base strip, said frond lines being made of metallocene catalyzed linear low density polyethylene;

(b) at least one retaining strap or line extending transversely through the base strips of each frond line for maintaining the frond lines in the fan-folded arrangement; and (c) means for anchoring the fan-folded frond lines to the bed of the body of water.

2. The mat of claim 1 wherein the linear low density polyethylene has a density of less than 0.9 and not less than 0.8.

3. The mat of claim 1 wherein the strands extend from 0.3 to 2 meters above the base strip.

4. The mat of claim 1 wherein the strands are from 1.2 to 5 cm. in width.

* * * * *